US012234662B1

(12) United States Patent
Driscoll

(10) Patent No.: US 12,234,662 B1
(45) Date of Patent: Feb. 25, 2025

(54) APPARATUS FOR SUPPORTING A POSTED STRUCTURE WHICH IS FIXABLE TO A PLANKED STRUCTURE

(71) Applicant: Paul J. Driscoll, Duxbury, MA (US)

(72) Inventor: Paul J. Driscoll, Duxbury, MA (US)

( * ) Notice: Subject to any disclaimer, the term of this patent is extended or adjusted under 35 U.S.C. 154(b) by 0 days.

(21) Appl. No.: 18/637,908

(22) Filed: Apr. 17, 2024

(51) Int. Cl.
*E04H 12/22* (2006.01)

(52) U.S. Cl.
CPC ..... *E04H 12/22* (2013.01); *E04H 12/2261* (2013.01); *E04H 12/2215* (2013.01); *E04H 12/2269* (2013.01)

(58) Field of Classification Search
CPC . E04H 12/2261; E04H 12/2269; E04H 12/22; E04H 12/2215
See application file for complete search history.

(56) References Cited

U.S. PATENT DOCUMENTS 5,120,016 A * 6/1992 Dysarz ..... A01K 97/10 248/539
5,542,367 A 8/1996 DuBois, III et al.
5,685,517 A * 11/1997 Salibra ..... A01K 97/10 248/539
5,813,163 A 9/1998 Dysarz
5,941,191 A * 8/1999 Dysarz ..... E02B 3/24 114/230.26
5,961,091 A 10/1999 Petryna et al.
6,015,139 A * 1/2000 Weber ..... E04H 12/2261 52/298
6,955,330 B1 10/2005 Weiser et al.
7,575,215 B1 8/2009 Clark et al.
8,327,575 B1 12/2012 Zalewski
D733,545 S * 7/2015 Charette ..... D8/387
10,323,788 B2 6/2019 Budleski
10,563,815 B2 2/2020 Budleski
10,641,002 B2 5/2020 Szmyr
10,907,766 B2 2/2021 Budleski
11,306,503 B1 * 4/2022 Cupp, Jr. ..... E04H 17/009
11,339,920 B2 5/2022 Budleski
11,473,306 B2 * 10/2022 Nill ..... E04D 13/00
11,933,062 B2 * 3/2024 Elpers ..... E04H 12/2253

FOREIGN PATENT DOCUMENTS

DE 202008017649 U1 5/2010
DE 202009014777 U1 12/2010

* cited by examiner

*Primary Examiner* — Omar F Hijaz
(74) *Attorney, Agent, or Firm* — Budzyn IP Law, LLC

(57) ABSTRACT

An apparatus for supporting a posted structure is provided which is fixable to a planked structure. The apparatus includes a base plate having: top and bottom faces; first and second intersecting axes which separate the top face of the base plate into first, second, third, and fourth quadrants; and first, second, third, and fourth apertures formed in the four quadrants, respectively. The apparatus further includes an upstanding cylinder extending from the top face of the base plate at the intersection of the first and second axes; and, first, second, third, and fourth locking bolts each having: an elongated shank; and, an elongated locking member fixed transversely to the shank, the locking member being sized to pass through spacing between a pair of adjacent planks of the planked structure. Locking nuts are provided for threadedly mounting to threads of each the first, second, third, and fourth locking bolts.

14 Claims, 8 Drawing Sheets

APPARATUS FOR SUPPORTING A POSTED STRUCTURE WHICH IS FIXABLE TO A PLANKED STRUCTURE

TECHNICAL FIELD

The subject invention relates to apparatuses for fixing a posted structure to a planked structure.

BACKGROUND

Supports configured to receive a posted structure and for mounting to a planked structure are known in the prior art. This allows each support to hold a posted structure relative to the planked structure. For example, the following patents each disclose a support, configured to receive a posted structure, and which includes one rotatable locking member which is passable between planks of a planked structure and, once passed through the planks, is rotatable to a locked position which resists movement of the support from the planked structure: German Utility Model No. DE 20 2009 014 777 U1 to Kotter-Rolf, U.S. Pat. No. 5,813,163 to Dysarz; U.S. Pat. No. 6,955,330 to Weiser et al.; U.S. Pat. No. 7,575,215 to Clark et al.; U.S. Pat. No. 8,327,575 to Zalewski; U.S. Pat. No. 10,323,788 to Budleski; and, U.S. Pat. No. 11,339,920 to Budleski. The single point of fixation of these designs is limited against wind, particularly, when in use on waterside planked structures.

The prior art also includes supports for posted structures, which are fixable to planked structures, and, which have two rotatable locking members, e.g., as shown in German Utility Model No. DE 20 2008 017 649 U1 to Giggenbach, U.S. Pat. No. 5,685,517 to Salibra, and U.S. Pat. No. 5,961,091 to Petryna et al. These designs provide the two locking members along a single axis which intersects the central support. As such, there is limited resistance to forces applied transversely to the single axis, such as crosswinds.

SUMMARY OF THE INVENTION

An apparatus for supporting a posted structure is provided herein, the apparatus being fixable to a planked structure having planks separated by spacings, the apparatus including a rectangular base plate having: a top face; a bottom face opposite to the top face; a perimeter extending about the base plate between the top and bottom faces, the perimeter including: spaced-apart first and second ends; and, spaced-apart first and second sides extending between the first and second ends; a first axis, lying along the top face, and generally perpendicular to the first end; a second axis, lying along the top face, and generally perpendicular to the first side, wherein the second axis intersects the first axis to separate the top face of the base plate into first, second, third, and fourth quadrants; a first aperture being formed in the first quadrant, spaced from both the first and second axes, to extend through the top and bottom faces; a second aperture being formed in the second quadrant, spaced from both the first and second axes, to extend through the top and bottom faces; a third aperture being formed in the third quadrant, spaced from both the first and second axes, to extend through the top and bottom faces; and, a fourth aperture being formed in the fourth quadrant, spaced from both the first and second axes, to extend through the top and bottom faces. The apparatus further includes an upstanding, hollow cylinder extending from, and rigidly affixed to, the top face of the base plate at the intersection of the first and second axes; and, first, second, third, and fourth locking bolts each having: an elongated shank which extends along a longitudinal axis between first and second shank ends, wherein the first, second, third, and fourth apertures are each formed to allow the elongated shank to pass therethrough; and, an elongated locking member fixed to the first shank end to be transverse to the longitudinal axis of, and extend from, the shank, the locking member being sized to pass through the spacing between a pair of adjacent planks of the planked structure, wherein, the shank is threaded between the first shank end and the second shank end. First, second, third, and fourth locking nuts are provided for threadedly mounting to the shank of the first, second, third, and fourth locking bolts, respectively.

Advantageously, the subject invention provides a support for a posted structure, which is fixable to a planked structure at multiple, spaced-apart points to provide multiaxial resistance to transverse forces such as winds in multiple cardinal directions.

As used herein, a "planked structure" refers to a horizontal structure having spaced-apart planks, such as the horizontal platform of a pier, wharf, quay, boardwalk, and the like, which is for supporting people and objects. The planked structure may be raised and supported by pilings and/or land. The planks may be wooden, plastic (e.g., recycled plastic), or combinations thereof. In addition, as used herein, a "posted structure" is a structure which includes a weight-bearing post, such as an umbrella, flagpole, chair, table, plant stand, light fixture, sign, billboard, advertising board, announcement board, and so forth. A "posted structure" may be also an ornamental element, such as a cut tree or bush (e.g., a Christmas tree, Hannukah bush), with a trunk of the cut tree or bush acting as the weight-bearing post.

DETAILED DESCRIPTION

Figure 1:
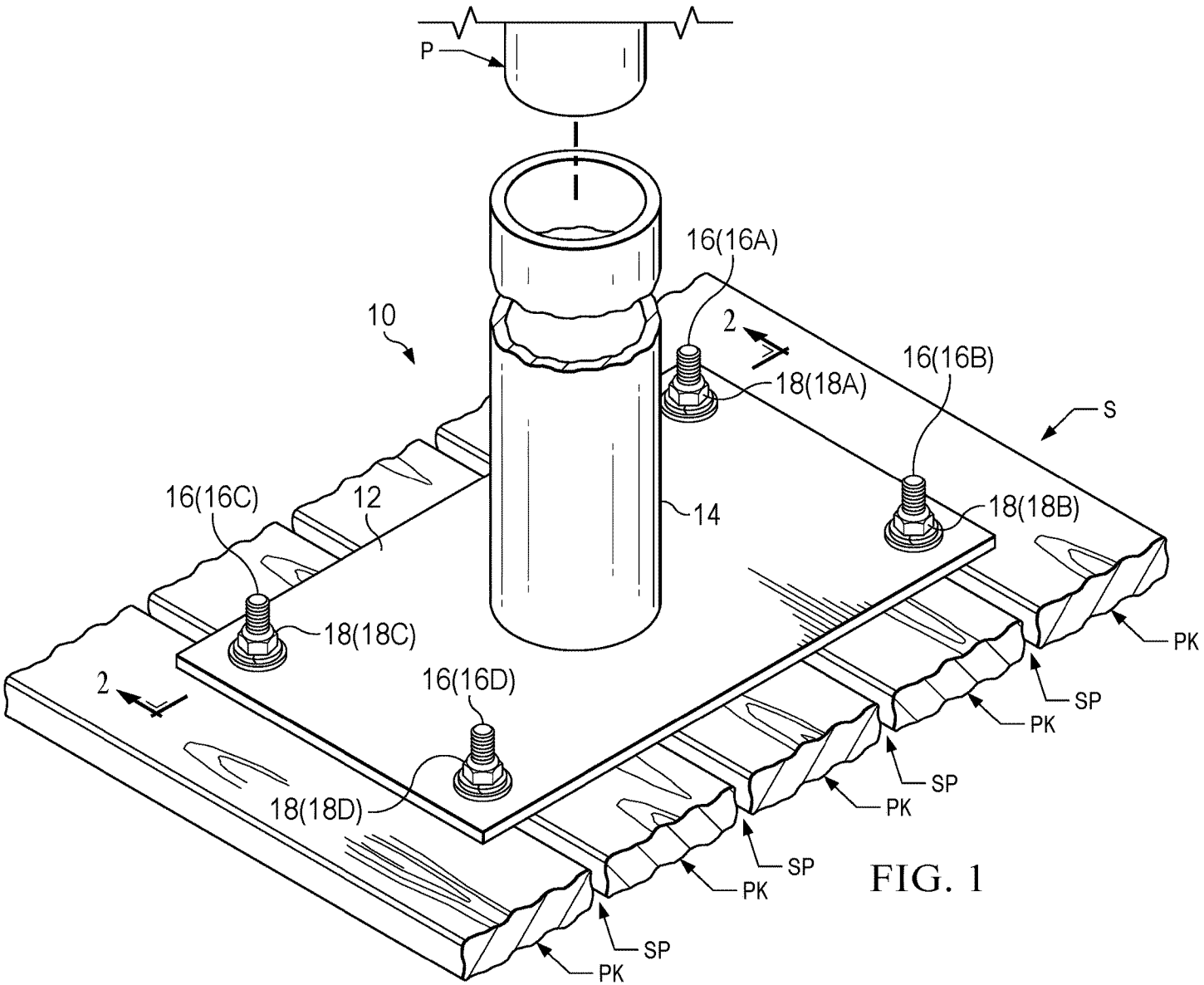
FIG. 1 is a perspective view of an apparatus formed in accordance with the subject invention.

With reference to FIG. 1, an apparatus 10 is provided for supporting a posted structure P and which is fixable to a planked structure S. The planked structure S includes planks PK which are separated by spacings SP. Advantageously, the apparatus 10 provides a rigid support for the posted structure P relative to the planked structure S so as to fix the posted structure P relative to the planked structure S. The apparatus 10 generally includes a base plate 12, an upstanding, hollow cylinder 14, a plurality of locking bolts 16, and a plurality of locking nuts 18.

Figure 2:
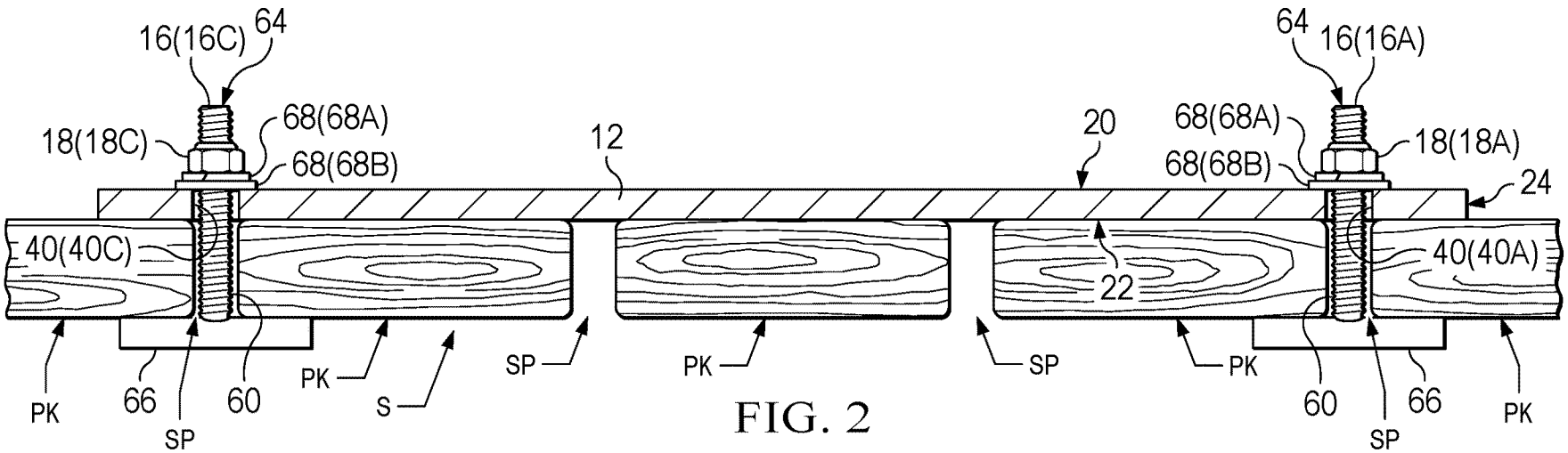
FIG. 2 is a cross-sectional view taken along line 2-2 of FIG. 1.
Figure 3:
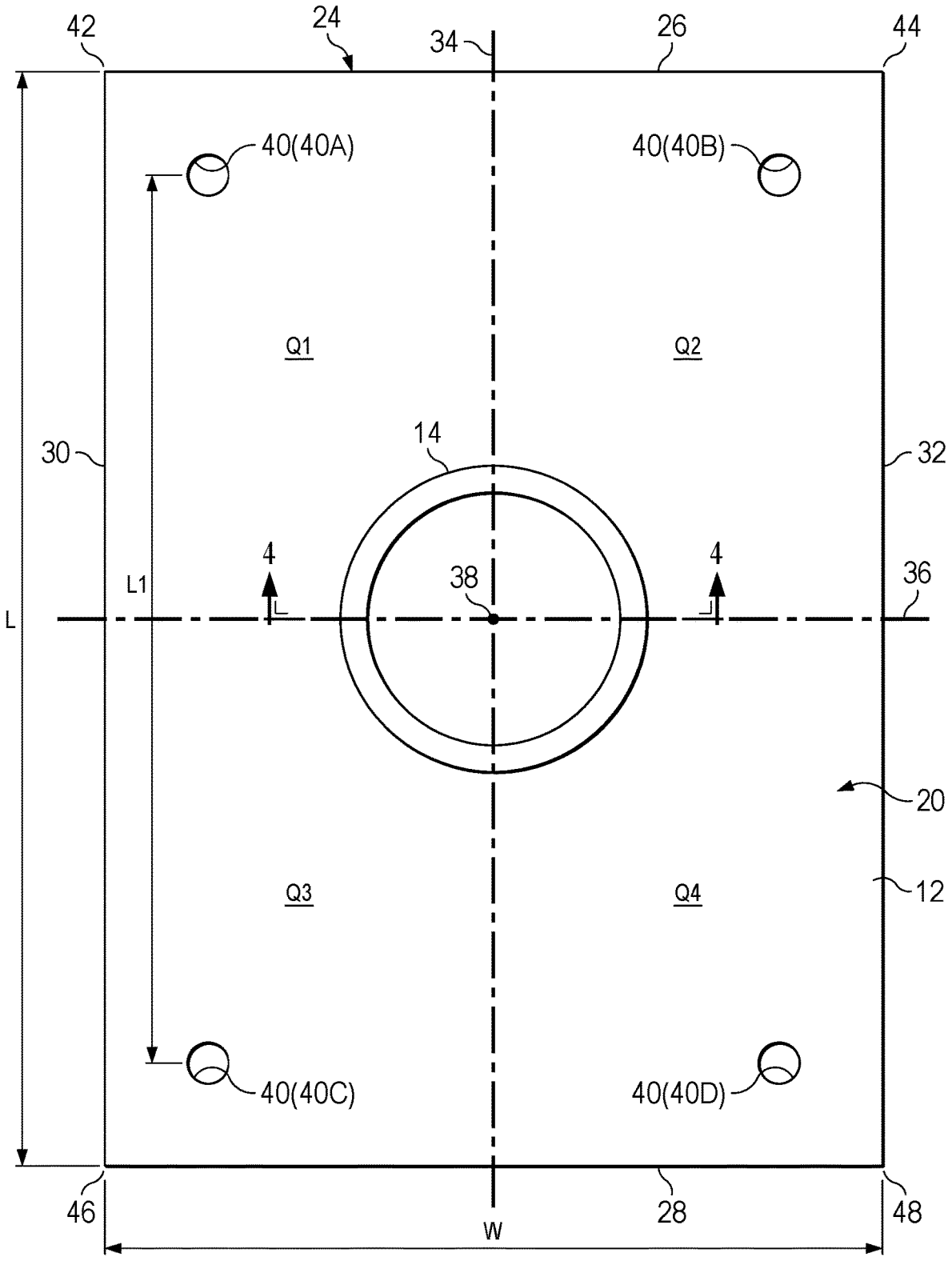
FIG. 3 is a top plan view of a base plate and cylinder in accordance with the subject invention.

As shown in FIGS. 2 and 3, the base plate 12 is plate-shaped with opposing top and bottom faces 20, 22. A perimeter 24 extends about the base plate 12 between the top and bottom faces 20, 22. The base plate 12 may be rectangular with the perimeter 24 including spaced-apart first and second ends 26, 28 and spaced-apart first and second sides 30, 32, which extend between the first and second ends 26, 28. With the base plate 12 being rectangular, the first and second ends 26, 28 may be parallel, and, the first and second sides 30, 32 may be parallel. Furthermore, the first side 30 may be arranged perpendicularly to the first end 26 and/or the second end 28, with the second side 32 also possibly being arranged perpendicularly to the first end 26 and/or the second end 28. As will be appreciated by those skilled in the art, the base plate 12 may be of other shapes, such as being circular, elliptical, or irregular, with the first and second ends 26, 28 being spaced apart, the first and second sides 30, 32 being spaced apart, and the first and second sides 30, 32 being located between the first and second ends 26, 28.

As shown in FIG. 3, a first axis 34 may be virtually superimposed on the base plate 12 which lies along the top face 20 and is generally perpendicular to the first end 26. In addition, a second axis 36 may be virtually superimposed on the base plate 12 which lies along the top face 20 and is generally perpendicular to the first side 30. The first and second axes 34, 36 intersect at intersection 38 to separate the top face 20 of the base plate 12 into virtual quadrants, namely, first, second, third, and fourth quadrants Q1, Q2, Q3, Q4.

The base plate 12 includes a plurality of apertures 40 useable to fix the base plate 12, and, thus, fix the apparatus 10, to the planked structure S. Preferably, the apertures 40 are spaced about multiple sides of the intersection 38. By way of non-limiting example, the apertures 40 may be arranged such that: a first aperture 40A is formed in the first quadrant Q1, spaced from both the first and second axes 34, 36, to extend through the top and bottom faces 20, 22; a second aperture 40B is formed in the second quadrant Q2, spaced from both the first and second axes 34, 36, to extend through the top and bottom faces 20, 22; a third aperture 40C is formed in the third quadrant Q3, spaced from both the first and second axes 34, 36, to extend through the top and bottom faces 20, 22; and, a fourth aperture 40D is formed in the fourth quadrant Q4, spaced from both the first and second axes 34, 36, to extend through the top and bottom faces 20, 22. By being spaced from both the first and second axes 34, 36, each of the first, second, third, and fourth apertures 40A, 40B, 40C, 40D defines moment arms along two coordinate directions (the moment arms being perpendicular to the first and second axes 34, 36, respectively). This arrangement provides for multiaxial resistance to transverse forces applied to the apparatus 10, particularly force applied transversely to the cylinder 14 and/or a posted structure P supported by the cylinder 14. Preferably, the intersection 38 is equidistant from the apertures 40, e.g., being equidistant from each of the first, second, third, and fourth apertures 40A, 40B, 40C, 40D.

In a possible arrangement, the apertures 40 are located in proximity to corners of the base plate 12. For example, the first aperture 40A may be located in proximity to a first corner 42 along the perimeter 24 of the base plate 12 defined by the intersection of the first end 26 and the first side 30; the second aperture 40B may be located in proximity to a second corner 44 along the perimeter 24 of the base plate 12 defined by the intersection of the first end 26 and the second side 32; the third aperture 40C may be located in proximity to a third corner 46 along the perimeter 24 of the base plate 12 defined by the intersection of the second end 28 and the first side 30; and, the fourth aperture 40D may be located in proximity to a fourth corner 48 along the perimeter 24 of the base plate 12 defined by the intersection of the second end 28 and the second side 32.

The base plate 12 may be of various dimensions with a length L between the first and second ends 26, 28 and a width W between the first and second sides 30, 32. The length L must be sufficient to span at least one plank PK to allow the apparatus 10 to be fixed to the planked structure S. By way of non-limiting example, the length L and the width W may be both 24.5 inches.

Figure 8:
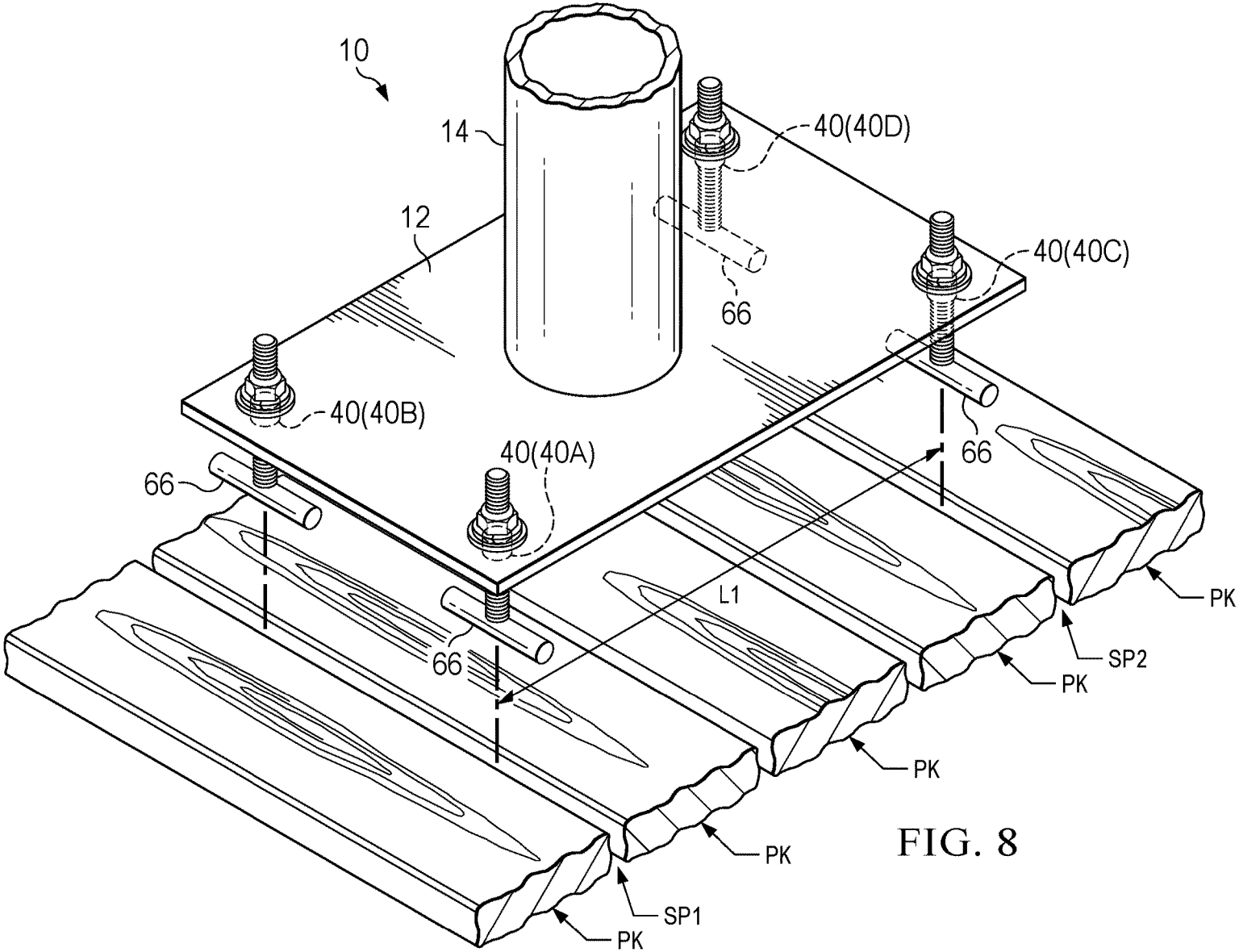
FIG. 8 shows installation of the apparatus.

In addition, the apertures 40 must be located to align with spacings SP between the planks PK. For example, as shown in FIG. 8, the first and second apertures 40A, 40B may be collinearly aligned with a first of the spacings SP1, at a distance of L1 from the third and fourth apertures 40C, 40D which are collinearly aligned with a second of the spacings SP2. The distance L1 may be based on typical widths of the planks PK (e.g., nominally 4"-12" (actual width being: 3.5"-11.25")) and spacings SP (e.g., 0.125"-1.0") of a planked structure S. For example, with the width of the planks PK being each 5.5" and the spacing SP being 0.5", and three planks PK being spanned, the distance L1 may be set to: [3×5.5" ]+[2×0.5" ]+[2×0.25" ]=18.0". This calculated L1 accounts for spanning three of the planks PK, two of the spacings SP (fully spanned), and twice half of the spacings SP to align the apertures 40A, 40B, 40C, 40D with the spacings SP1, SP2 for mounting.

As will be recognized by those skilled in the art, the apparatus 10 may be provided in different sizes to accommodate different size planks PK (e.g., the length L1 is varied in the different offerings). In addition, or alternatively, the base plate 12 may be provided with multiple apertures 40 in each of the quadrants Q1, Q2, Q3, Q4, spaced apart to allow for different mounting locations. The apertures 40 may be formed with partially stamped knockouts which are removable for mounting. In addition, the base plate 12 may be drilled on-site to form the apertures 40 based on dimensions of the planked structure S for installation.

The base plate 12 may be of metallic (e.g., steel) or polymeric construction, particularly being sufficiently robust to resist bending.

The cylinder 14 is rigidly affixed to the top face 20 of the base plate 12 so as to be upstanding in extending away from the top face 20. Preferably, the cylinder 14 is affixed to the top face 20 at the intersection 38 of the first and second axes 34, 36. This allows the cylinder 14 to be equidistant from each of the apertures 40. In addition, preferably, the cylinder 14 is perpendicular to the top face 20. The cylinder 14 may be attached to the base plate 20, e.g., by welding, adherence, or mechanical connection, or formed unitarily therewith (e.g., by molding or machining). The cylinder 14 may be of metallic or polymeric construction.

Figure 4:
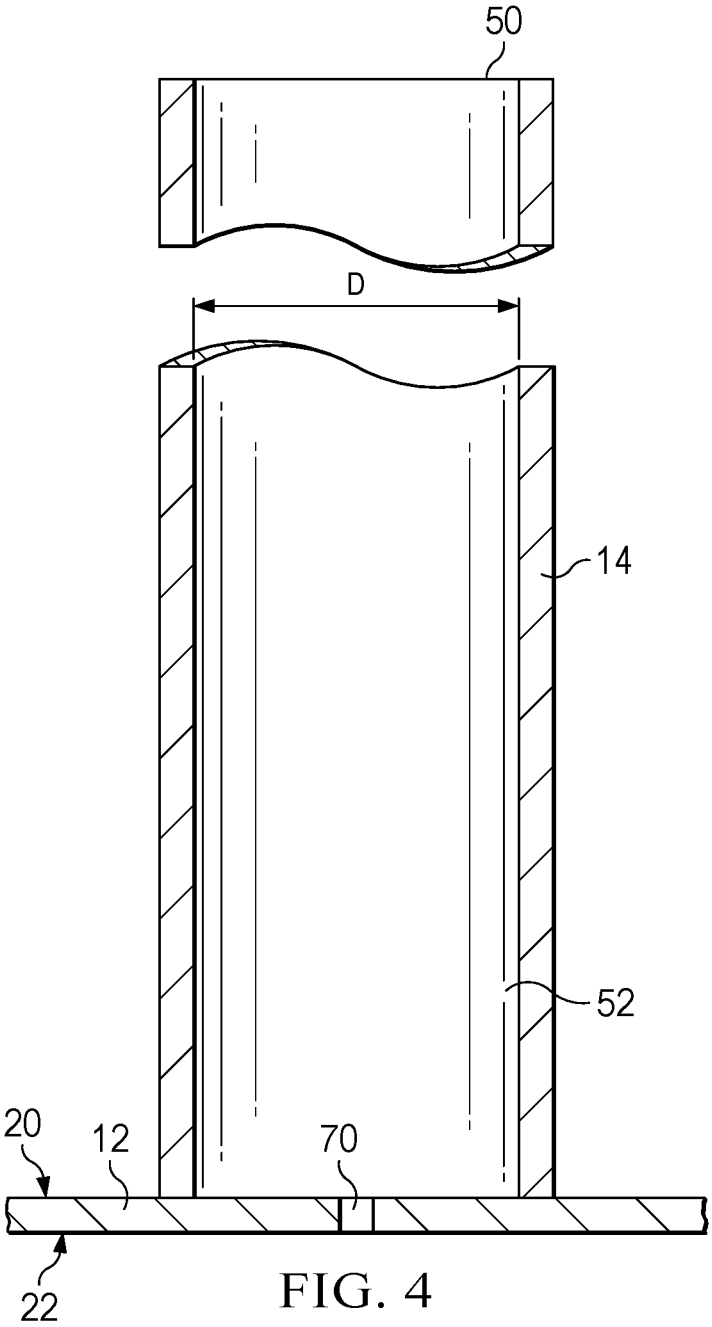
FIG. 4 is a partial cross-sectional view taken along line 4-4 of FIG. 3.

With reference to FIG. 4, the cylinder 14 has an open free end 50 located away from the top face 20, with open lumen 52 extending from the free end 50 to the top face 20. The lumen 52 defines a passageway for receiving the posted structure P. The diameter D of the lumen 52 is preferably in the range of 4.0-6.0 inches (e.g., 4.25 inches) to allow for a range of different-diameter posted structures P. In addition, it is preferred that the cylinder 14 have a minimum length (as measured between the top face 20 and the free end 50) to accept a sufficient length of the posted structure P to provide rigid support therethrough. The minimum length may be 10 inches, more preferably, 20 inches. By way of non-limiting example, the cylinder 14 may have a length of 30 inches as measured between the top face 20 and the free end 50. The cylinder 14 will extend about the received length of the posted structure P in providing upright support thereto. One or more drain holes 70 may be formed through the plate 12, in alignment with the lumen 52, to allow drainage of water captured in the lumen 52.

It is noted that if the diameter of the posted structure P closely matches the diameter D of the lumen 52, an interference fit may be formed between the posted structure P and the cylinder 14 which may sufficiently maintain the posted structure P within the cylinder 14. It has been found by the inventor herein that the trunk of a Christmas tree may be trimmed to match the diameter D of the lumen 52 with the cylinder 14 holding the Christmas tree without further restraints. If the diameter of the posted structure P is less than the diameter D of the lumen 52, one or more wedges or spacers may be utilized to hold the posted structure P within the cylinder 14. In addition, or alternatively, one or more openings may be formed in the cylinder 14 for receiving threaded or insertable locking screw(s) and/or rod(s) that may press against the posted structure P in applying a holding force thereto. As will be recognized by those skilled in the art, other means for holding the posted structure P relative to the cylinder 14 may be utilized.

Figure 5:
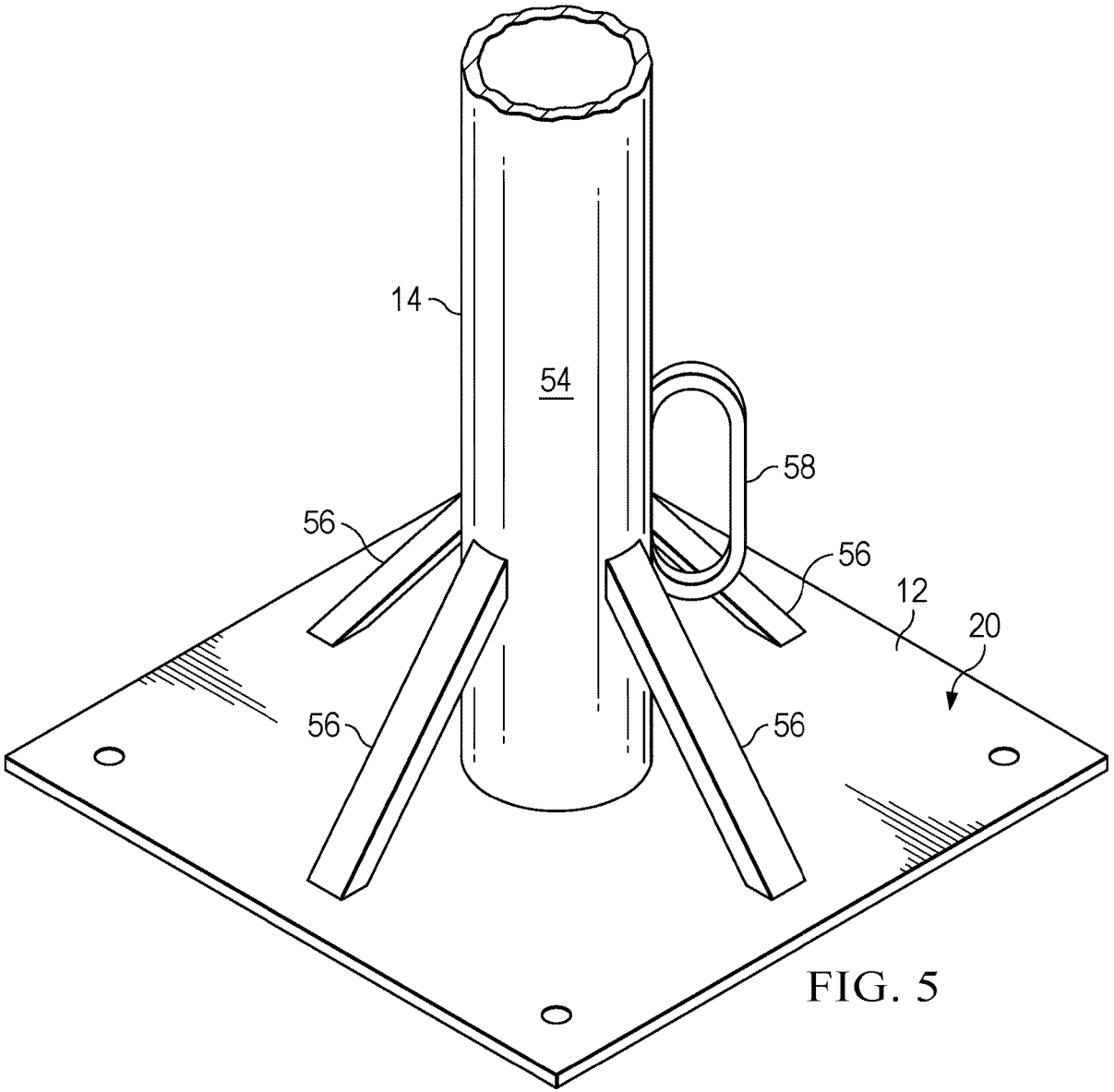
FIG. 5 is a perspective view of the cylinder being provided with struts and a handle in accordance with the subject invention.

With reference to FIG. 5, to reinforce the cylinder 14, one or more struts 56 may be provided to extend between the exterior surface 54, spaced from the top face 20, and the top face 20. The one or more struts 56 provide lateral support to the cylinder 14. A plurality of the struts 56 may be provided, evenly spaced about the circumference of the cylinder 14. In addition, one or more handles 58 may be provided on the exterior surface 54 of the cylinder 14 and/or the top face 20 to facilitate handling of the apparatus 10. If a plurality of the handles 58 is provided, it is preferred the handles 58 be evenly spaced about the circumference of the cylinder 14.

Figure 6:
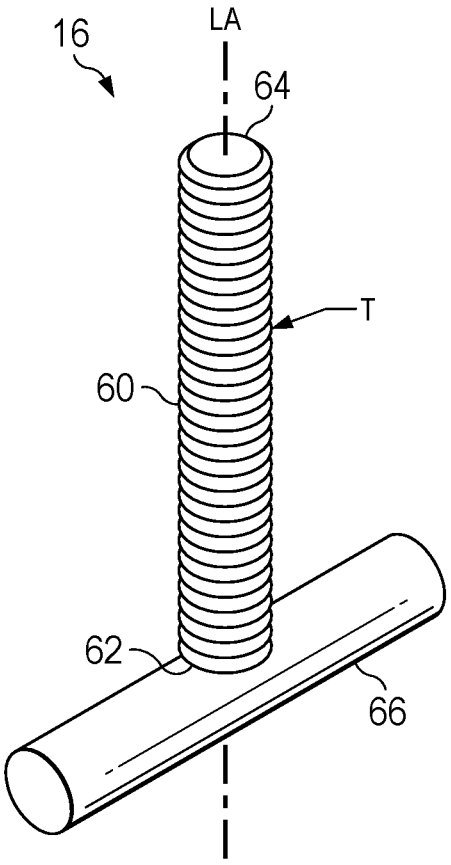
FIGS. 6-7 show locking bolts useable with the subject invention.
Figure 7:
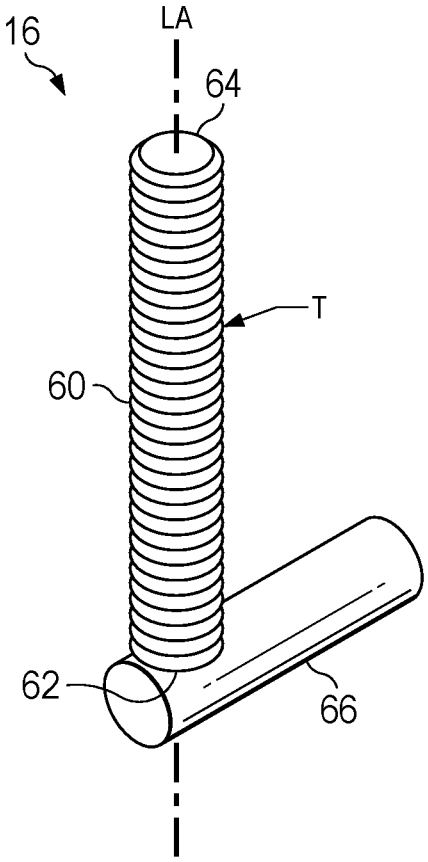

The locking bolts 16 are provided in correspondence to the quantity of the apertures 40. Thus, with four of the apertures 40, four of the locking bolts 16 (16A, 16B, 16C, 16D) are provided. As shown in FIGS. 6-7, each of the locking bolts 16 includes an elongated shank 60 which extends along a longitudinal axis LA between first and second shank ends 62, 64. The apertures 40 are each formed to allow the shank 60 to pass therethrough. In use, the shanks 60 of the locking bolts 16 extend through the apertures 40.

For each of the locking bolts 16, an elongated locking member 66 is fixed to the first shank end 62 to be transverse to the longitudinal axis LA of, and extend from, the shank 60. The locking member 66 may extend from one side of the shank 60 to define an L-shape with the shank 60 (FIG. 7). Alternatively, the locking member 66 may extend from both sides of the shank 60 in defining a T-shape with the shank 60 (FIG. 6). In either variation, the locking member 66 must have a sufficient length so that during use the locking member 66 extends from the shank 60, which is received in one of the spacings SP, to a location below adjacent plank(s) PK.

The locking member 66 must be sized (i.e., be sufficiently narrow) to pass through the spacing SP between a pair of adjacent planks PK for installation. Likewise, the shank 60 must be sized (i.e., be sufficiently narrow) to pass through the spacing SP.

In use, as shown in FIG. 2, the shank 60 extends through the spacing SP and through the base plate 12 with the locking member 66 being below the planks PK and the second shank end 64 protruding from the top face 20. Thus, the shank 60 must have sufficient length to extend from below the planks PK to a location above the top face 20. In addition, the shank 60 is threaded between the first shank end 62 and the second shank end 64. Threads T must be provided on the shank 60 which are accessible above the top face 20 of the base plate 12 during use. The shank 60 must have sufficient length to extend above the top face 20 with the threads T being accessible. Preferably, the threads T extend from the second shank end 64 with sufficient length to draw the locking members 66 into pressing engagement with adjacent planks PK, as described below.

The locking nuts 18 are provided in correspondence to the quantity of the locking bolts 16. Thus, with four of the locking bolts 16, four of the locking nuts 18 (18A, 18B, 18C, 18D) are provided. The locking nuts 18 are formed to threadedly mount to the shanks 60, particularly to the threads T thereof, of the locking bolts 16 when installed. It is preferred that the locking nuts 18 each be formed to not be passable through any of the apertures 40 (e.g., be each dimensioned to overlap portions of the top face 20 when threadedly secured to the respective shank 60).

One or more washers 68 may be provided between each of the locking nuts 18 and the top face 20 of the base plate 12. The washers 68 may be sized to overlap portions of the top face 20 outside the respective aperture 40. The washers 68 may be flat and/or split. The split washer may be configured as a lock washer formed to resist loosening of an associated locking nut 18. With reference to FIG. 2, in a preferred arrangement, a split washer 68A and a flat washer 68B are provided for each of the locking bolts 16 with the split washer 68A adjacent to the corresponding locking nut 18 and the flat washer 68B between the split washer 68A and the top face 20 of the base plate 12.

Figure 9:
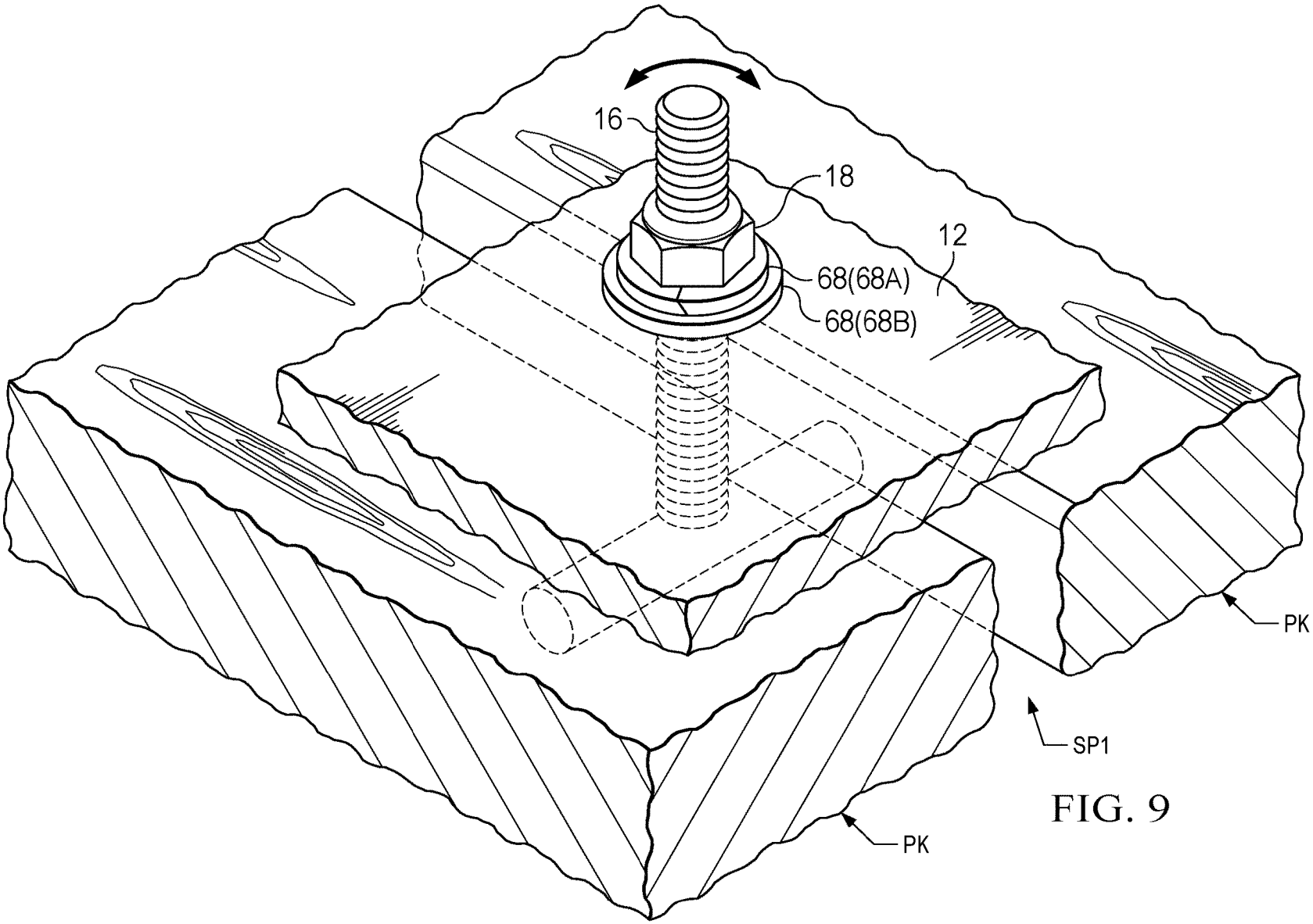
FIG. 9 shows an installed locking bolt.

For installation, the locking bolts 16 are inserted through the apertures 40, with the second shank ends 64 of the locking bolts 16 protruding from the top face 20 and the first shank ends 62 of the locking bolts 16 protruding from the bottom face 22. Any washers 68 being used are slipped over the second shank ends 64 of the locking bolts 16, with the locking nuts 18 being threadedly mounted to the shanks 60 of each of the locking bolts 16. As shown in FIG. 8, the locking nuts 18 may be sufficiently tightened to support in hanging arrangement the locking bolts 16 with the base plate 12 being held horizontally above the ground. The base plate 12 is then located above the installation site so that the locking bolts 16 align with the spacings SP1, SP2. Once aligned, the base plate 12 may be lowered to a resting position on the planked structure S with the locking bolts 16 extending through the spacings SP1, SP2. In sequence, as shown in FIG. 9, each of the locking bolts 16 is rotated to locate the locking members 66 below adjacent planks PK and, while maintaining this position, the locking nuts 18 are tightened till the locking members 66 come into pressing engagement with the adjacent planks PK. Preferably, the locking members 66 are positioned to be generally perpendicular to the spacings SP1, SP2. With all the locking nuts 18 tightened, and the locking members 66 in pressing engagement with the adjacent planks PK, holding force is generated for maintaining the apparatus 10 fixed to the planked structure S. A posted structure P may be placed into the cylinder 14 to be supported thereby. The apparatus 10 may be removed by loosening the locking nuts 18, rotating the locking members 66 into alignment with the spacings SP1, SP2, and lifting the base plate 12.

The apparatus 10 should have a robust construction to resist forces applied thereto, particularly under harsh conditions. The apparatus 10 may be formed of corrosion-resistant materials, or be coated or treated with corrosion-resistant paint or the like, to extend product life, particularly if intended for use in marine environment.

What is claimed is:

1. An apparatus for supporting a posted structure, the apparatus being fixable to a planked structure having planks separated by spacings, the apparatus comprising:

i. a rectangular base plate having:

a top face;

a bottom face opposite to the top face;

a perimeter extending about the base plate between the top and bottom faces, the perimeter including:

spaced-apart first and second ends; and, spaced-apart first and second sides extending between the first and second ends;

a first axis, lying along the top face, and generally perpendicular to the first end;

a second axis, lying along the top face, and generally perpendicular to the first side, wherein the second axis intersects the first axis to separate the top face of the base plate into first, second, third, and fourth quadrants;

a first aperture being formed in the first quadrant, spaced from both the first and second axes, to extend through the top and bottom faces;

a second aperture being formed in the second quadrant, spaced from both the first and second axes, to extend through the top and bottom faces;

a third aperture being formed in the third quadrant, spaced from both the first and second axes, to extend through the top and bottom faces; and, a fourth aperture being formed in the fourth quadrant, spaced from both the first and second axes, to extend through the top and bottom faces;

ii. an upstanding, hollow cylinder extending from, and rigidly affixed to, the top face of the base plate at the intersection of the first and second axes;

iii. first, second, third, and fourth locking bolts each having:

an elongated shank which extends along a longitudinal axis between first and second shank ends, wherein the first, second, third, and fourth apertures are each formed to allow the elongated shank to pass therethrough; and, an elongated locking member fixed to the first shank end to be transverse to the longitudinal axis of, and extend from, the elongated shank, the locking member being sized to pass through the spacing between a pair of adjacent planks of the planked structure, wherein, the elongated shank is threaded between the first shank end and the second shank end;

iv. first, second, third, and fourth locking nuts for threadedly mounting to the elongated shank of the first, second, third, and fourth locking bolts, respectively; and, v. one or more struts extending between an exterior surface of the cylinder and the top face, wherein, the one or more struts are each fixed:

to the exterior surface of the cylinder at a location spaced from the top face; and, to the top face at a location spaced from the cylinder, wherein, each of the one or more struts bounds a triangular gap with the cylinder and the top face, wherein the first aperture and the second aperture are collinearly aligned so as to align with a first common spacing in fixing the apparatus to the planked structure, the third aperture and the fourth aperture are collinearly aligned so as to align with a second common spacing in fixing the apparatus to the planked structure.

2. The apparatus of claim 1, wherein the intersection of the first and second axes is generally equidistant from each of the first, second, third, and fourth apertures.

3. The apparatus of claim 1, wherein the first aperture is in proximity to a first corner along the perimeter of the base plate defined by the intersection of the first end and the first side.

4. The apparatus of claim 3, wherein the second aperture is in proximity to a second corner along the perimeter of the base plate defined by the intersection of the first end and the second side.

5. The apparatus of claim 4, wherein the third aperture is in proximity to a third corner along the perimeter of the base plate defined by the intersection of the second end and the first side.

6. The apparatus of claim 5, wherein the fourth aperture is in proximity to a fourth corner along the perimeter of the base plate defined by the intersection of the second end and the second side.

7. The apparatus of claim 1, wherein, for each of the first, second, third, and fourth locking bolts, the elongated locking member is formed so as to extend from both sides of the shank in defining a T-shape with the respective shank.

8. The apparatus of claim 1, further comprising a first washer to be mounted over the shank of the first locking member adjacent to the first locking nut, the first washer being formed to overlap portions of the top face, outside the first aperture, with the shank of the first locking member extending through the first aperture and the first washer being mounted over the shank of the first locking member.

9. The apparatus of claim 8, wherein the first washer is located to be between the first locking nut and the top face of the base plate.

10. The apparatus of claim 9, wherein the first washer is a split washer.

11. The apparatus of claim 10, further comprising a second washer mounted over the shank of the first locking member located between the first washer and the top face of the base plate, the second washer being formed to overlap portions of the top face, outside the first aperture, with the shank of the first locking member extending through the first aperture and the second washer being mounted over the shank of the first locking member.

12. The apparatus of claim 11, wherein the second washer is a flat washer.

13. The apparatus of claim 1, wherein the one or more struts each subtend an acute angle with the top face.

14. The apparatus of claim 1, wherein the cylinder includes an open free end and an open lumen extending therefrom towards the top face, and, wherein at least one drain hole is formed in the base plate to extend between, and through, the top face and the bottom face, the at least one drain hole being in alignment with the lumen.

* * * * *